US007040325B2

(12) United States Patent
Dombek et al.

(10) Patent No.: US 7,040,325 B2
(45) Date of Patent: May 9, 2006

(54) METHOD OF AND APPARATUS FOR CONVOLUTING BANDS AROUND ROD-SHAPED ARTICLES

(75) Inventors: Manfred Dombek, Dassendorf (DE); Berthold Maiwald, Schwarzenbek (DE)

(73) Assignee: Hauni Maschinenbau Aktiengesellschaft, Hamburg (DE)

( * ) Notice: Subject to any disclaimer, the term of this patent is extended or adjusted under 35 U.S.C. 154(b) by 209 days.

(21) Appl. No.: 10/095,466

(22) Filed: Mar. 13, 2002

(65) Prior Publication Data

US 2002/0129823 A1 Sep. 19, 2002

(30) Foreign Application Priority Data

Mar. 13, 2001 (DE) ..... 101 12 336

(51) Int. Cl.

| | |
|---|---|
| ***A24C 5/10*** | (2006.01) |
| ***A24C 1/30*** | (2006.01) |
| ***A24C 1/26*** | (2006.01) |
| ***A24C 1/28*** | (2006.01) |

(52) U.S. Cl. ..... 131/27.1; 131/32; 131/36; 131/55; 131/58

(58) Field of Classification Search ..... 131/280, 131/27.1, 28, 32, 35, 36, 50, 55, 58; 53/211; 100/155

See application file for complete search history.

(56) References Cited

U.S. PATENT DOCUMENTS

| | | | | | |
|---|---|---|---|---|---|
| 2,188,998 | A | | 2/1940 | Edwards | |
| 3,203,431 | A | * | 8/1965 | Pembroke et al. | 131/27.1 |
| 3,251,367 | A | * | 5/1966 | Kuhl | 131/27.1 |
| 4,191,198 | A | * | 3/1980 | Chopko et al. | 131/76 |
| 4,445,519 | A | | 5/1984 | Hinz et al. | |
| 4,644,961 | A | * | 2/1987 | Horie et al. | 131/94 |
| 5,024,242 | A | * | 6/1991 | Garthaffner et al. | 131/94 |
| 5,135,008 | A | | 8/1992 | Oesterling et al. | |
| 5,577,518 | A | * | 11/1996 | Draghetti et al. | 131/32 |
| 6,363,942 | B1 | * | 4/2002 | Dombek et al. | 131/281 |
| 2001/0032651 | A1 | * | 10/2001 | Dombek | 131/281 |

FOREIGN PATENT DOCUMENTS

| | | | |
|---|---|---|---|
| DE | 672216 | | 2/1939 |
| DE | 1 188 494 | | 3/1955 |
| DE | 32 01 859 | A1 | 8/1982 |
| DE | 198 57 576 | A1 | 6/2000 |
| DE | 19907008 | A1 * | 8/2000 |
| EP | 1013183 | A2 * | 6/2000 |
| EP | 1 055 376 | | 11/2000 |
| GB | 1046489 | * | 10/1966 |

* cited by examiner

*Primary Examiner*—Steven P. Griffin
*Assistant Examiner*—Carlos Lopez
(74) *Attorney, Agent, or Firm*—Venable LLP; Catherine M. Voorhees

(57) ABSTRACT

Adhesive-coated bands of paper, tipping paper or plastic foil are convoluted around discrete one-piece or composite rod-shaped articles, such as coaxial plain cigarettes and filter mouthpieces, during travel through a rolling zone bounded by a pair of surfaces at least one of which moves relative to the other. The inlet of the rolling zone receives articles, each of which carries a non-convoluted band, from a conveyor which forms part of a pressing device operative immediately ahead of the inlet of the rolling zone and serving to press successively delivered bands against the respective articles and to effect an at least slight flattening of the articles immediately prior to entry into the rolling zone. The width of the path for the articles increases at the outlet of the rolling zone or immediately downstream of such outlet.

17 Claims, 7 Drawing Sheets

400
96
97
432
444
93
438
428
94
408
406
412
411
2
16
18
414
410
95
420
442
434
436
440

METHOD OF AND APPARATUS FOR CONVOLUTING BANDS AROUND ROD-SHAPED ARTICLES

CROSS-REFERENCE TO RELATED CASES

The present application claims the priority of the commonly owned copending German patent application Ser. No. 101 12 336.1 filed Mar. 13, 2001. The disclosures of the aforementioned priority application and of each US and foreign patent and patent application identified in the specification of the present application are incorporated herein by reference.

BACKGROUND OF THE INVENTION

The invention relates to improvements in methods of and in apparatus for convoluting strips or bands of paper or the like around rod-shaped articles, such as groups of coaxial smokers' products including plain cigarettes, cigarillos, cigars and filter mouthpieces for tobacco smoke, lead pencils, color pencils, crayons, markers and other rod-shaped stationery products and/or others. One of the presently preferred applications of such methods and uses of such apparatus is to non-movably connect to each other filter mouthpieces and plain cigarettes, cigarillos, cigars and/or other tobacco-containing articles prior to subdivision into rod-shaped filter cigarettes, cigars, cigarillos or the like.

It is known to convolute adhesive-coated uniting bands or strips (hereinafter called bands) around groups of coaxial plain cigarettes, cigars or cigarillos and filter mouthpieces, and to thereupon subdivide each of the thus obtained products into two or more filter cigarettes cigars or cigarillos. Reference may be had, for example, to commonly owned U.S. Pat. No. 5,135,008 granted Aug. 4, 1992 to Oesterling et al. A machine which is used for the making of filter cigarettes or the like is known as MAX and is distributed by the assignee of the present application. The band convoluting operation in such machines is carried out in such a way that successive composite rod-shaped articles of a series of such articles are moved sideways toward and into a rolling channel. Each composite article carries an adhesive-coated uniting band which is to be convoluted around that portion or those portions of the composite rod-shaped articles where the neighboring sections or parts of the articles abut each other. If a composite article consists of two plain cigarettes of unit length and a rod-shaped filter mouthpiece of double unit length between the plain cigarettes of unit length, the uniting band is convoluted around the entire filter mouthpiece and around the adjacent inner end portions of the plain cigarettes. The thus obtained filter cigarette of double unit length is thereupon severed midway across the convoluted uniting band to yield two filter cigarettes of unit length.

One of the two surfaces bounding the rolling channel moves relative to the other surface, or both surfaces are in motion but at different speeds, so that the articles advancing through the rolling zone are caused to turn about their respective axes while moving sideways; this causes the adhesive-coated uniting bands to become convoluted around the mouthpiece of double unit length and around the adjacent inner portions of the plain cigarettes. Similar procedures can be resorted to in order to convolute uniting bands (e.g., bands carrying advertising matter) around lead pencils, crayons, color pencils, markers and other rod-shaped stationery products.

The just described methods and apparatus are further described in commonly owned U.S. patent application Ser. No. 09/481,182 which corresponds to German patent application No. 198 575 76 A1. The apparatus which is disclosed in this commonly owned US patent application employs a conveyor which advances rod-shaped articles (each of which carries an adhesive-coated flat or substantially flat uniting band, directly into the rolling channel or zone. This can cause problems as far as the quality of the ultimate products (such as filter cigarettes) is concerned. Thus, abrupt entry of composite rod-shaped articles and of the uniting bands which adhere to the articles into the inlet of the wrapping or rolling zone can affect the appearance of the ultimate products and/or the quality of the seal or seals which is or which are to be established at the junctions of plain cigarettes and filter mouthpieces in the filter cigarettes. One of the reasons is that the abrupt entry of a rod-shaped article from the region immediately preceding the rolling zone (where the articles do not turn about their respective axes) into the rolling zone where the articles are compelled to turn due to the width of the rolling zone, i.e., because the width of such rolling zone is less than the diameter of a non-deformed rod-shaped article, can result in a shifting of the rod-shaped article and the respective uniting band relative to each other.

OBJECTS OF THE INVENTION

An object of our invention is to provide a novel and improved method of predictably convoluting bands around discrete rod-shaped articles or groups of two or more coaxial (aligned) rod-shaped articles.

Another object of the present invention is to provide a novel and improved method of enhancing the appearance of products wherein an adhesive-coated band or partially coated band surrounds a one-piece or composite rod-shaped article.

A further object of the invention is to provide a method of the above outlined character which can be resorted to in connection with the manipulation of mass-produced commodities such as smokers' products, writing implements and the like.

An additional object of the instant invention is to provide a novel and improved apparatus which can be utilized for the practice of the above outlined method.

Still another object of the invention is to provide an apparatus wherein the articles to be confined in convoluted bands of paper or the like are manipulated in a novel and improved way preparatory and/or subsequent to rolling of the bands therearound.

A further object of our invention is to provide a novel and improved combination of conveyors which can be utilized to advance rod-shaped articles and the bands toward, through and beyond the article rolling station.

Another object of the invention is to provide the above outlined apparatus with novel and improved means for selecting and/or varying the distances between neighboring rod-shaped artcles on their way toward, through and beyond the rolling station.

An additional object of the invention is to provide a simple, compact and relatively inexpensive apparatus which can be utilized with advantage in machines for the making of rod-shaped smokers' products, in machines for the making of pencils, crayons and other substantially rod-shaped writing implements, as well as in numerous other machines.

SUMMARY OF THE INVENTION

One feature of the present invention resides in the provision of a method of convoluting flexible bands around rod-shaped articles having predetermined diameters, e.g., deformable articles each of which can consist of two or more coaxial portions or parts. One side of each band can be coated with a suitable adhesive and each band is or can be in more or less linear contact with each section of a composite article so that, when the band is convoluted around the respective composite article, it connects all of the sections of such article to each other.

The improved method comprises a first step of advancing a series of successive articles, with portions of bands appended thereto, sideways in a predetermined direction along a predetermined path toward the inlet of a rolling zone or channel having a width which is less than the predetermined diameter of an oncoming article and bounded by a pair of surfaces at least one of which moves relative to the other so that an article entering the rolling zone is caused to roll and the respective band is convoluted around it. The improved method further comprises the step of pressing the bands against the respective articles immediately upstream of the inlet, as seen in the predetermined direction.

If the articles are compressible (e.g., deformable in response to the application of pressure thereto), the pressing step includes or can include deforming the articles in the second zone of their path, i.e., upstream of the inlet of the rolling zone. For example, the pressing step can include reducing the diameter of a portion of or of each successive article to at least approximate the predetermined width of the rolling zone.

The advancing step can include moving the articles and the respective bands toward the second zone at a speed which at least approximates the speed of one of the surfaces bounding the rolling zone.

Another feature of the present invention resides in the provision of an apparatus for convoluting flexible bands around rod-shaped articles each of which has a predetermined diameter. The improved apparatus comprises rolling means defining a rolling zone or channel having an inlet. The rolling means includes first and second surfaces which flank the rolling zone and confront each other across the rolling zone. At least one of the surfaces is arranged to move relative to the other surface and the distance between the two surfaces is less than the predetermined diameter of an article. The apparatus further comprises means for advancing a series of successive artcles, with portions of bands adhering thereto, sideways in a predetermined direction along a predetermined path toward and into the inlet of the rolling zone, and means for pressing the bands against the respective articles in a portion of the path immediately upstream of the inlet of the rolling zone (as seen in the predetermined direction).

If the bands are readily flexible and the rod-shaped articles are deformable, the width of the aforementioned portion of the path preferably decreases toward the inlet of the rolling zone to an extent such that the articles undergo at least some very slight deformation on their way into the rolling zone.

The width of the aforementioned portion of the path can decrease gradually, preferably all the way to the inlet of the rolling zone.

Furthermore, the width (such as the minimum width) of the aforementioned portion of the path can match or at least approximates the distance between the two surfaces which flank the rolling zone.

The aforementioned portion of the path for the articles toward and into the rolling zone is bounded by third and fourth surfaces one of which is or can be provided on the advancing means. The other of the third and fourth surfaces is or can be provided on a component of the rolling means.

The advancing means can comprise a drum which is rotatable about a predetermined axis and has a peripheral surface provided with article advancing elements which are at least substantially parallel to the axis of the drum. The advancing elements can comprise projections with or adjacent suction ports that attract the articles to the peripheral surface of the drum and to the adjacent article advancing elements.

The rolling means can comprise at least one endless flexible conveyor which serves to move successive articles of the series of articles sideways.

It is also possible to design the rolling means in such a way that it comprises two endless flexible conveyors (such as endless belts) each of which is provided with one of the first and second surfaces.

Still further, it is possible to design the rolling means in such a way that it comprises at least one stationary rolling member; one of the first and second surfaces is then provided on the stationary rolling member.

The first and second surfaces of the rolling means can include portions which flank the outlet of the rolling zone; such portions of the first and second surfaces can diverge from each other at the outlet of the rolling zone. Portions of the first and second surfaces (i.e., those portions which flank the outlet of the rolling zone) can diverge gradually or in a stepwise fashion. The inlet and outlet of the rolling zone can be disposed at or close to the same level; this is the case when the rolling zone is horizontal. Alternatively, the inlet and the outlet can be at different levels; for example, the rolling channel can be vertical or nearly vertical.

If the articles are composite rod-shaped smokers' articles and the bands are coated with adhesive so that they can adhere to the respective articles, the first and second surfaces are or can be arranged to convolute the uniting bands around the respective composite articles so that the convoluted bands hold the sections or parts of the respective composite articles against movement relative to each other.

The novel features which are considered as characteristic of the invention are set forth in particular in the appended claims. The improved band convoluting apparatus itself, however, both as to its construction and the modes of assembling, installing and operating the same, together with numerous additional important and advantageous novel features and attributes thereof, will be best understood upon perusal of the following detailed description of certain presently preferred specific embodiments and applications with reference to the accompanying drawing.

DESCRIPTION OF PREFERRED EMBODIMENTS

Figure 1:
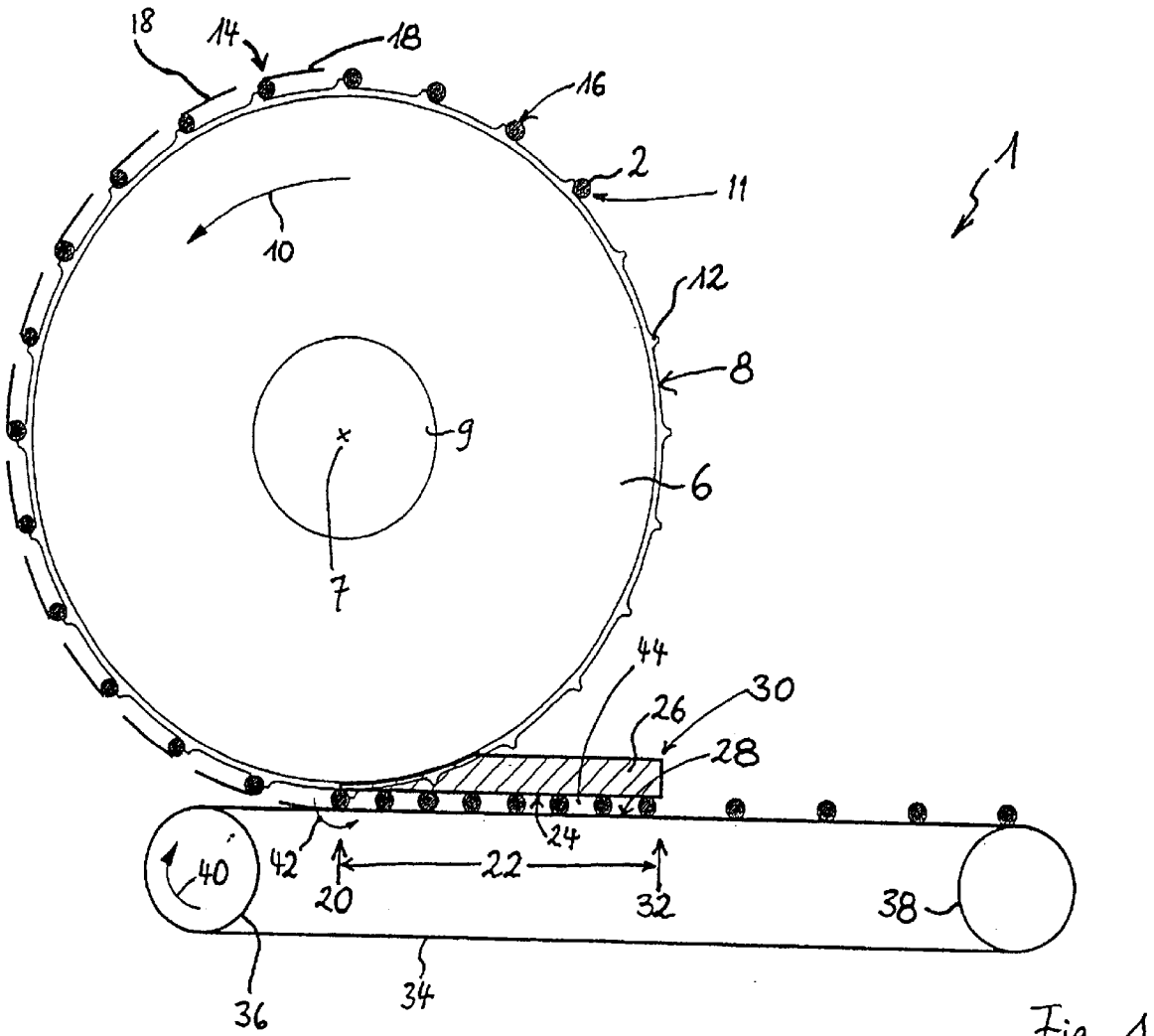
FIG. 1 is a schematic partly elevational and partly vertical sectional view of an apparatus which embodies one form of the present invention and can be utilized, for example, in so-called tipping machines for the making of filter cigarettes or analogous rod-shaped smokers' products.

FIG. 1 shows the relevant details of an apparatus 1 which embodies one form of the present invention and can be utilized, for example, in a tipping machine which turns out filter cigarettes or the like. The rod-shaped articles 2 to be confined in tubes consisting of convoluted sheet-like bands 18 are assumed to consist of several coaxial rod-like sections or parts such as those shown at 22 in FIG. 3 of the aforementioned U.S. Pat. No. 5,135,008 to Oesterling et al. The bands 18 are assumed to consist of tipping paper and one side of each such band is coated with a suitable adhesive. Each band 18 is in substantially linear contact with each section of the respective article 2 so that, when the convoluting step is completed, the thus obtained tube (converted band) holds the sections of the respective article 2 against any movement relative to each other. The diameter 48 (see FIG. 2) of each non-deformed rod-shaped article 2 is assumed to be the same, and such articles are deformable in response to the application of external pressure substantially radially toward their longitudinal axes.

The means for advancing successive articles 2 of a series of such articles toward the inlet 20 of an elongated straight horizontal or substantially horizontal rolling zone or station or channel 44 includes a horizontal drum-shaped conveyor 6 (hereinafter called drum for short) having a series of equidistant article advancing and retaining or attracting elements 12 which project outwardly from the cylindrical peripheral surface 8 of the drum 6 and are parallel to its axis 7. The means for rotating the drum 6 in a predetermined (counter-clockwise) direction (indicated by the arrow 10) includes a suitable prime mover, transmission or the like having a shaft 9. The station (at the apex of the drum 6) where successive articles 2 receive discrete adhesive-coated bands 18 from another conveyor (e.g., a chute, a second drum or the like, not shown) is denoted by the character 14. Each band 18 extends at least substantially tangentially of the peripheral surface of the respective article 2, and one of its four marginal portions adheres to such peripheral surface at a locus 16 remotest from the peripheral surface 8 of the drum 6.

The articles 2 of a series of such articles are delivered to the peripheral surface 8 of the drum 6 upstream of the station 14 (e.g., by a further drum-shaped conveyor, not shown), namely at a station denoted by the character 11. Each advancing element 12 (and/or the portion of the peripheral surface 8 in front of each such advancing element, as seen in the direction of arrow 10) is provided with one or more suction ports (not shown) which are in communication with a suction generating device (e.g., the intake of a blower or pump) during advancement of articles 2 from the station 11 toward the inlet 20 of the rolling zone 44. That side of each band 18 which faces the peripheral surface 8 of the drum 6 is coated with adhesive.

As already mentioned above, each article 2 is assumed to comprise several coaxial sections or parts, such as two plain cigarettes, cigars, cigarillos or other smokable material-containing parts of unit length and a filter mouthpiece for tobacco smoke of double unit length between them. However, it is also possible to treat rod-shaped artcles which contain plural sections containing different types of smokable material or composite filter mouthpieces for tobacco smoke. Still further, each article 2 can constitute a lead pencil, a mechanical pencil, a color pencil, a crayon, a marker or another rod-shaped stationery product, and the band (e.g., a plastic band) for such product can bear advertising matter, instructions for manipulation of mechanical pencils or the like.

The path along which the articles 2 are advanced sideways from the station 11 to the inlet 20 of the rolling zone 44, in the direction of arrow 10, is an arcuate path, and such path includes a portion 50 which is located immediately upstream of the inlet 20 and where, in accordance with a feature of the present invention, the bands 18 adhering to successive articles 2 are pressed against the portions 16 of the respective articles before they enter the rolling zone 44. The pressing step involves a gradual flattening of the articles 2 from a dimension matching the diameters 48 of the articles to a dimension equal to the width of the rolling zone 44 which is sufficiently less than the diameter 48 to thus ensure that the articles are caused to roll counterlockwise, as viewed in FIGS. 1 and 2, so that the bands are convoluted therearound before they reach the outlet 32 of the zone 44. Since the adhesive-coated sides of the bands 18 confront the peripheral surface 8 of the drum 6, they are less likely to be contaminated by impurities on their way toward the inlet 20.

The means for pressing the bands 18 against the portions 16 of the respective articles 2 includes those (successive) portions of the peripheral surface 8 of the drum 6 which are located immediately ahead of the inlet 20 and the adjacent portions of an endless belt conveyor 34 which is trained over a driver pulley 36 and a driven pulley 38. The pulley 36 is driven by a motor or the like (not shown) in a clockwise direction as indicated by the arrow 40 to advance the belt conveyor 34 at a speed matching that of the peripheral surface 8. This ensures that an article 2 advancing in the path portion 50 is not caused to turn about its axis, i.e., that the orientation of the band 18 relative to the surface 8 remains at least substantially unchanged. The double-headed arrow 45 denotes in FIG. 2 the gradually decreasing distance between the peripheral surface 8 and the surface 28 of the belt conveyor 34 in the region immediately upstream of the path portion 50.

Once an article 2 reaches the six o'clock position of the drum 6, it begins to roll about its axis in a counterclockwise direction (see the arrow 42) because it is then engaged by a first rolling surface 24 at the underside of a stationary rolling member 26, and by a second rolling surface 28, namely the outer side of the belt conveyor 34. The length 22 of the rolling zone 44 between the surfaces 24 and 28 is sufficient to ensure that each band 18 is fully convoluted around all sections or parts of the respective article 2 and that the distances between successive wrapped articles reaching the downstream end 30 of the stationary rolling member 26 at the outlet 32 of the rolling zone 44 are reduced in dependency upon the speed of the belt conveyor 34. The distances between successive articles 2 (with the bands 18 convoluted therearound) on the upper reach of the belt conveyor 34 between the outlet 32 and the idler pulley 38 can equal or approximate the distances between successive article advancing elements 12 at the periphery of the drum 6. The belt conveyor 34 delivers successive articles 2 to a further conveyor (not shown) which cooperates with a suitable cutoff to divide each such article into two or more finished articles, e.g., filter cigarettes of unit length.

Figure 2:
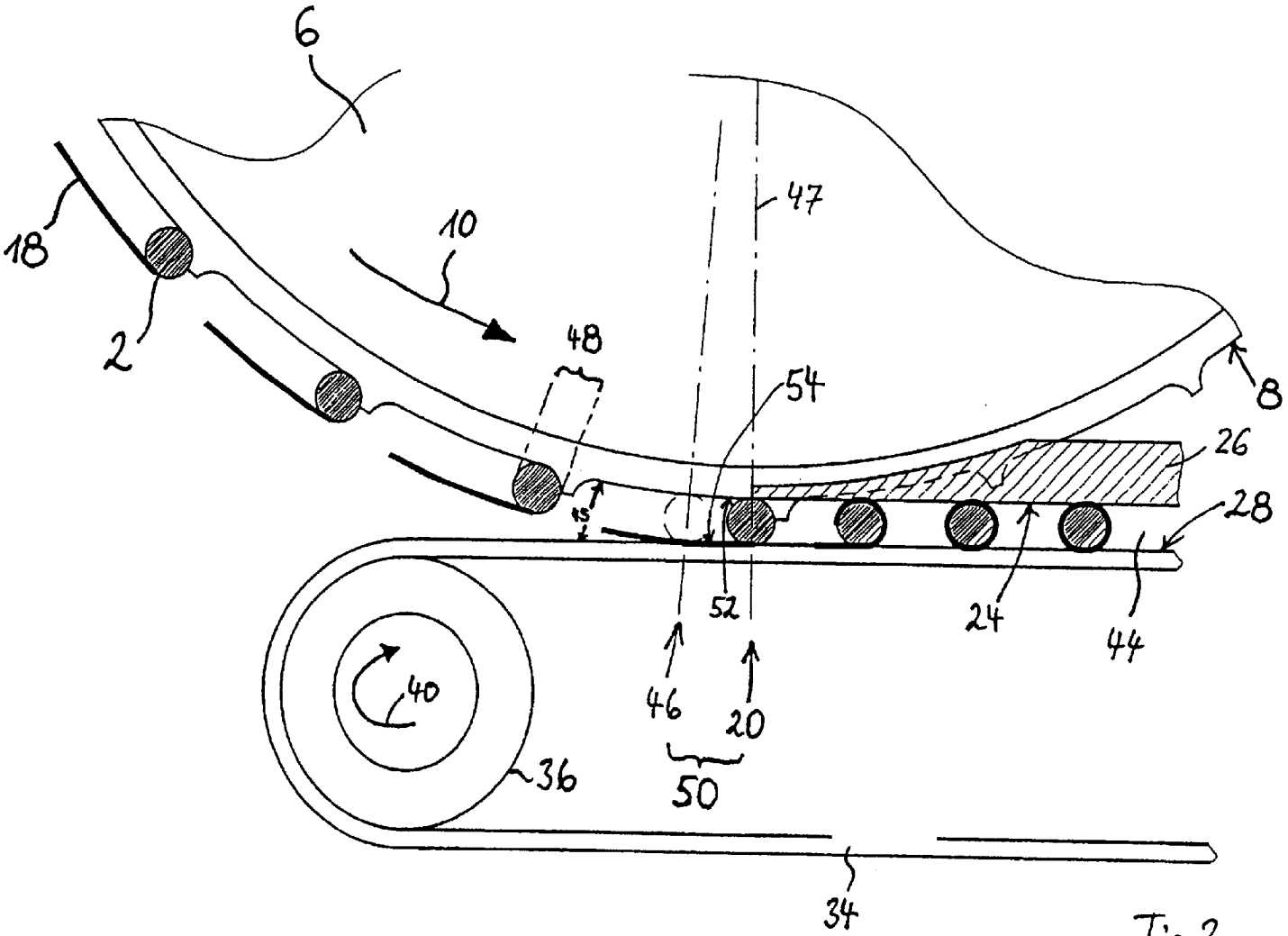
FIG. 2 is an enlarged view of a detail in the apparatus, namely of the structure around the inlet of the article rolling zone.

It will be seen that the apparatus 1 of FIGS. 1 and 2 need not employ a discrete conveyor between the drum 6 and the belt conveyor 34. This is due to the fact that the means which serves to press the bands 18 against the adjacent portions 16 of the articles 2 in the path portion 50 is defined in part by the drum 6 of the advancing means and in part by the conveyor 34 of the rolling means.

The surface 24 of the stationary rolling member 26 is tangential to the periphery of the drum 6, and the surface 28 of the belt conveyor 34 is parallel to the surface 24. The width of the rolling zone or channel 44 (i.e., the distance between the surfaces 24, 28) is less than the diameter 48 of an undeformed article 2, i.e., of an article upstream of the path portion 50. The angular distance between the radii 46, 47 of the drum 6 (at the inlet and outlet of the path portion 50 shown in FIG. 2) need not exceed a few degrees, as long as it suffices to ensure that an article 2 advancing sideways between the arcuate (convex) portion 52 of the peripheral surface 8 of the drum 6 and the portion 54 of the flat surface 28 suffices to ensure that the orientation of the article relative to that portion of the adhesive-coated side of the band 18 which adheres to the part 16 of the article remains unchanged during sidewise rolling movement through the zone 44.

In view of the aforementioned relationship between the speeds of the surfaces 8, 28 and 24, the spacing between successive articles 2 in the rolling zone 44 is half the spacing of neighboring articles on the drum 6. The speed of forward movement of articles 2 in the rolling zone 44 (as seen in the direction from the inlet 20 toward the outlet 32) is half the speed of forward movement of articles with the drum 6. However, and once the articles 2 bearing convoluted bands 18 advance beyond the outlet 32, their mutual spacing returns to that between the articles on the drum 6. The distance 45 begins to decrease below the diameter 48 of an undeformed article 2 starting at the radius 46 and reaches the width of the rolling zone 44 at the radius 47, i.e., at the inlet 20 immediately downstream of the path portion 50.

Figure 3:
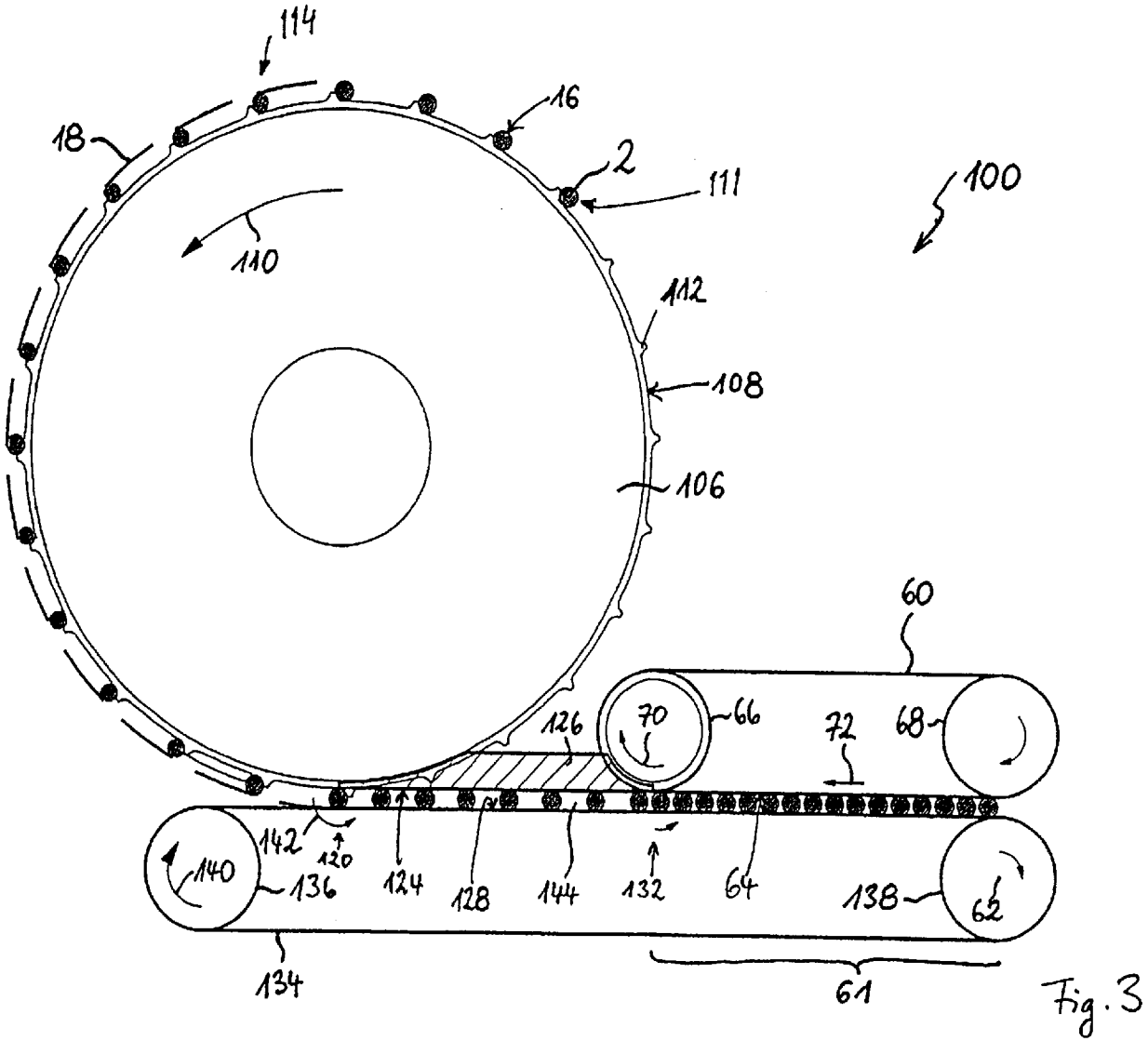
FIG. 3 is a partly elevational and partly vertical sectional view of an apparatus which constitutes a first modification of the apparatus shown in FIGS. 1 and 2.

FIG. 3 illustrates a second apparatus 100 which differs from the apparatus 1 of FIGS. 1 and 2 in that the rolling and convoluting means for the articles 2 and their respective bands 18 includes an endless belt or band conveyor 60 located immediately downstream of the stationary rolling member 126 corresponding to the rolling member 26 of the apparatus 1. All such parts of the apparatus 100 which are identical with or plainly analogous to the corresponding parts of the apparatus 1 are denoted by similar reference characters plus 100 and will be described again only if necessary for an understanding of the construction and mode of operation of the apparatus 100.

The belt conveyor 60 contacts successive articles 2 and their convoluted bands 18 immediately downstream of the outlet 132 of the rolling zone 144. The upper reach of the belt conveyor 134 advances in a direction to the right, as viewed in FIG. 3 (see the arrow 140), whereas the lower reach of the belt conveyor 60 advances in a direction to the left (see the arrow 72). The belt conveyor 60 is trained over pulleys or sheaves 66, 68 at least one of which is driven by a suitable prime mover in a direction indicated by arrow 70. The relationship between the speeds of the belt conveyors 134, 60 is such that the articles 2 in the channel between the surface 64 at the lower reach of the conveyor belt 60 and the surface 128 of the upper reach of the conveyor belt 134 move sideways at half the speed of the articles 2 in the rolling zone 144. This entails a halving of the spacing between neighboring articles in the region 61 between the outlet 132 of the rolling zone 144 and those portions at the nip of the pulleys 68, 138 which are nearest to each other. The character 62 denotes in FIG. 3 the axis of the pulley 138. This axis is located in a vertical plane which further includes the axis of the pulley 68 and the end of the second rolling region or zone 61 (between the outlet 132 and the nip of the pulleys 68, 138).

The aforediscussed selection of speeds of the peripheral surface 108, of the surface 128 and of the external surface of the belt conveyor 60, together with the direction of movement of the belt conveyor 60, ensures that the mutual spacing of articles 2 reaching the nip of the pulleys 68, 138 is 25 percent of mutual spacing of articles 2 at the peripheral surface 108 of the drum 106. The speed of sidewise movement of articles 2 in the region 61 equals or approximates the average or mean value of speeds of the belt conveyors 60 and 134.

Figure 4:
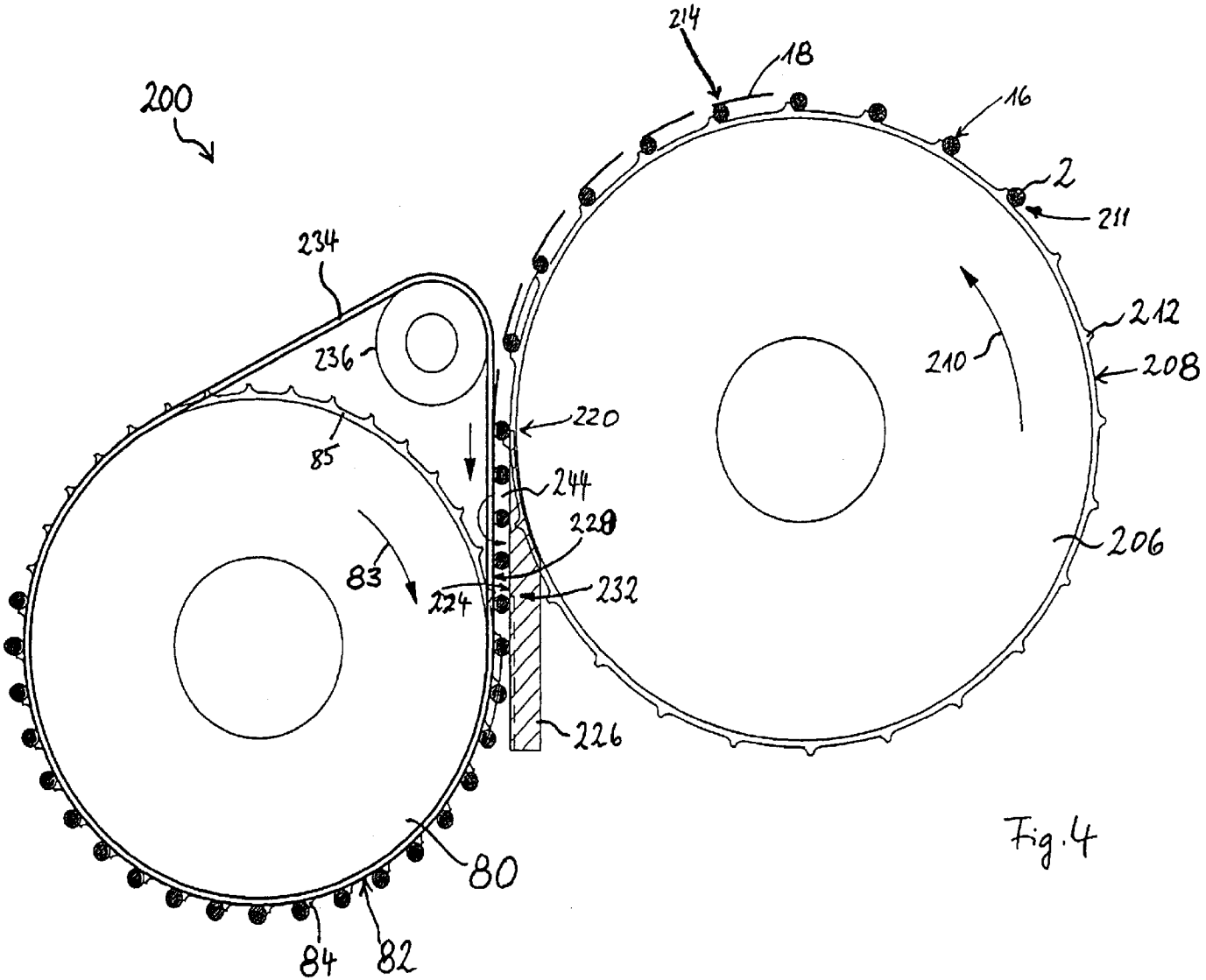
FIG. 4 is a partly elevational and partly sectional view of a third apparatus wherein, instead of being caused to advance through a substantially horizontal rolling channel, the articles are caused to move downwardly in a substantially vertical rolling channel.

FIG. 4 shows certain relevant components of a third rolling or convoluting apparatus 200. All such parts of the apparatus 200 which are identical with or plainly analogous to those in the apparatus 1 of FIGS. 1 and 2 are denoted by similar reference characters plus 200 and will be described only to the extent necessary for full understanding of the construction and operation of the apparatus 200.

A difference between the apparatus 1 and 200 is that the rolling channel or zone 244 extends at least substantially vertically downwardly, i.e., the outlet 232 of this rolling zone is located at a Level different from that (namely below) inlet 220. Furthermore, the pulley 38 for the belt conveyor 34 in the apparatus 1 is replaced with a rotary drum-shaped conveyor 80 having a cylindrical peripheral surface 82 provided with article advancing elements 84 similar or analogous or identical to the article advancing elements 212 of the drum 206.

The endless belt conveyor 234 preferably consists of one, two or more endless strips which are disposed in parallel vertical planes and portions of which extend into parallel circumferentially complete grooves 85 in the peripheral surface 82 of the pulley or drum 80. Reference may be had to the aforementioned commonly owned U.S. patent application Ser. No. 09/461,182 corresponding to German patent application No. 198 57 576 A1. An advantage of the apparatus 200 is that the transfer of successive treated articles 2 (with the bands 18 fully convoluted therearound) which reach the outlet 232 onto the drum or pulley 80 is effected gently and such articles are entrained by and attracted to the advancing elements 84 to be conveyed in the direction of arrow 83, e.g., into the range of the aforementioned cutoff which subdivides each wrapped article 2 into two or more discrete articles of unit length.

The rolling surface 224 of the stationary rolling member 226 is parallel to a tangent to the peripheral surface 82 of the conveyor or drum 80. This rolling surface 224 extends beyond the outlet 232 of the rolling zone 244, and those increments of the peripheral surface 82 which confront the surface 224 downstream of the outlet 232 move gradually away from the stationary rolling member 226 to thus ensure gradual relaxation of compression of the articles 2 with convoluted bands 18 thereon. The articles 2 continue to roll about their respective axes as long as they remain in simultaneous contact with the surfaces 224 and 228 downstream of the outlet 232.

The pulley or drum 80 further serves as a take-off conveyor for the articles 2 and the convoluted bands 18 thereon, e.g., as a means for delivering the articles 2 with convoluted bands 18 thereon to a station where the articles are severed to yield several finished rod-shaped products (such as filter cigarettes) of unit length. Such station is shown at 36, 37 in FIG. 1 of the aforementioned U.S. Pat. No. 5,135,008 to Oesterling et al.

Figure 5:
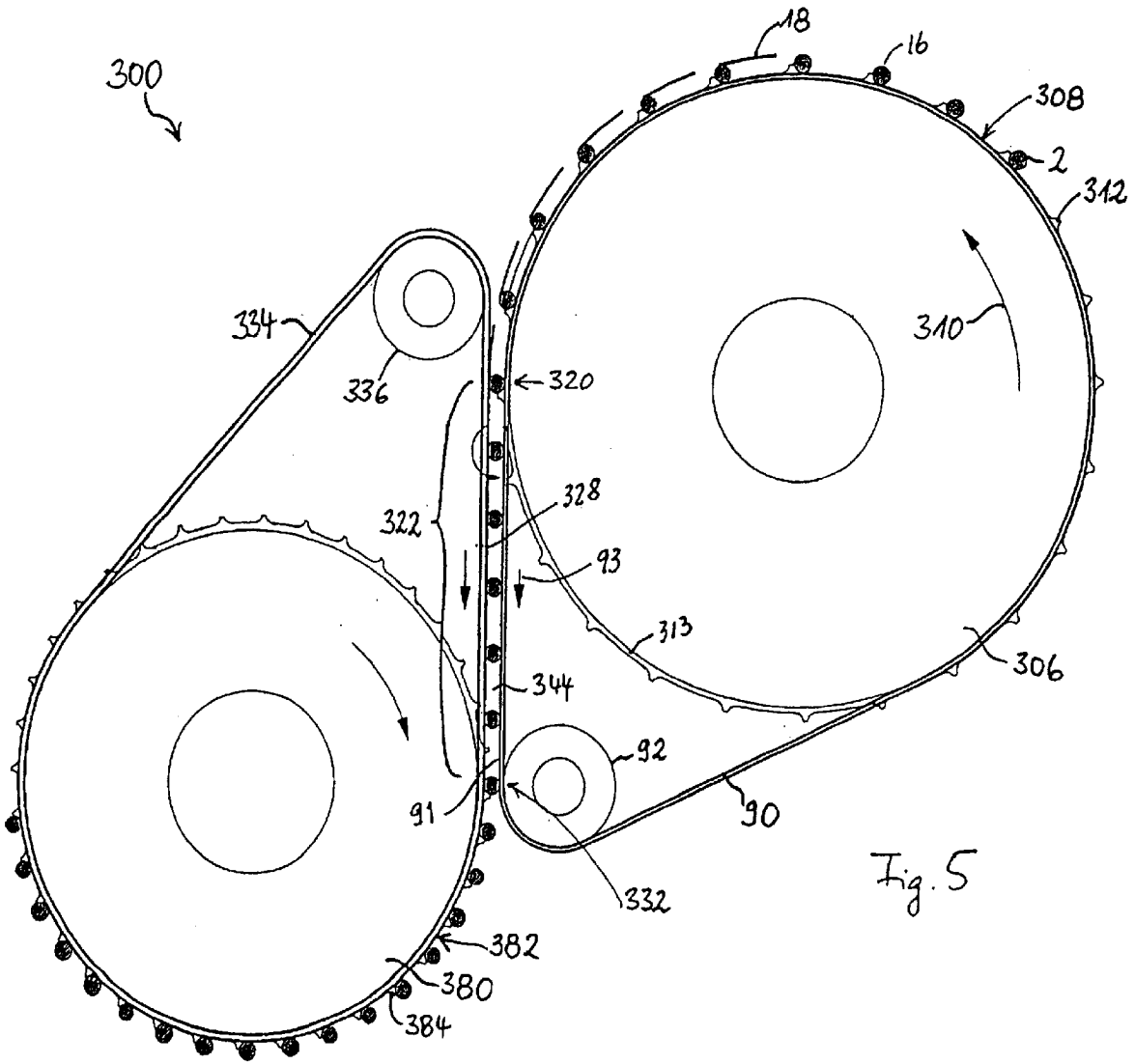
FIG. 5 is a similar view of an apparatus which constitutes a modification of the apparatus illustrated in FIG. 4.
Figure 6:
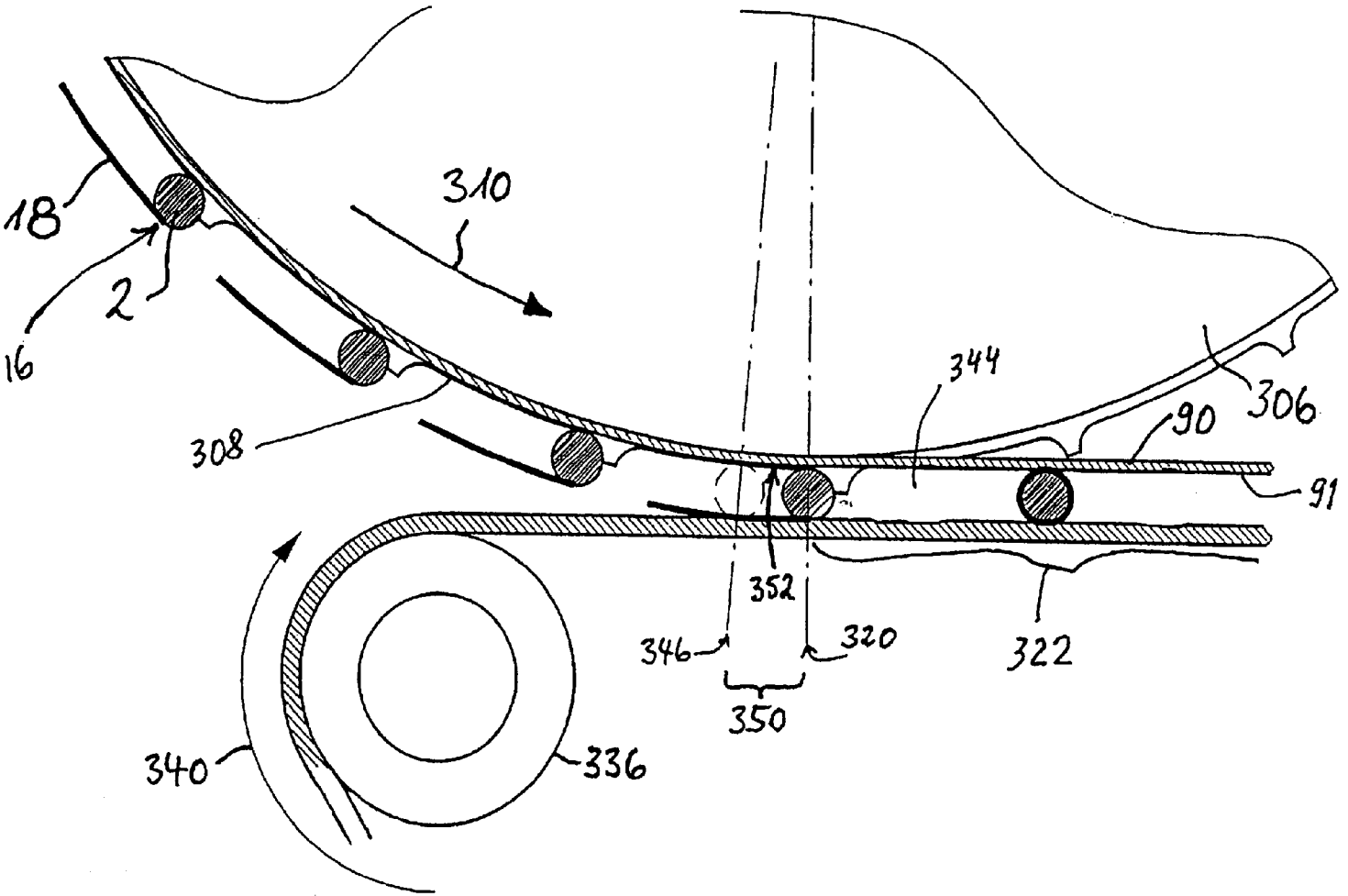
FIG. 6 is an enlarged view of a detail in the apparatus of FIG. 5 but turned counterclockwise with reference to the position which is illustrated in FIG. 5.

FIGS. 5 and 6 illustrate certain details of a fourth apparatus 300 which constitutes a modification of the apparatus 200. All such parts of the apparatus 300 which are identical with or plainly analogous to those of the apparatus 1 of FIGS. 1 and 2 and the apparatus 200 of FIG. 4 are denoted by similar reference characters plus 300 or 100 and will be described only to the extent necessary for full understanding of the construction and mode of operation of the apparatus 300.

A difference between the apparatus 1 and 300 is that the rolling means of the apparatus 300 does not employ any stationary rolling member(s) such as the rolling member 26. Instead, the apparatus 300 utilizes a further endless belt conveyor 90 which is trained over the drum 306 and also over an idler pulley or sheave 92. The manner in which the drum 306 cooperates with the endless belt conveyor 334 at and ahead of the inlet 320 of the rolling zone 344 to effect gradually increasing areas of contact between the bands 18 and the respective rod-shaped articles 2 (at portions 16 of the peripheral surfaces of the articles) is the same as already described with reference to FIGS. 1 and 2.

The belt conveyor 90 is trained over the drum 306 and over a pulley 92 in the same way as described in connection with the belt conveyor 234, take-off drum 80 and pulley 236 of FIG. 4.

The speed of the belt conveyor 234 matches that of the bands 18 adhering to the portions 16 of articles 2 being advanced sideways by the drum 306. However, the speed of the belt conveyor 90, which is driven in the direction of arrow 93, is half the speed of the belt conveyor 334. This causes the articles 2 to roll about their respective axes during sidewise movement in the rolling zone 344 in a direction (counterclockwise) to convolute the respective bands 18 therearound. The speed of sidewise movement of articles 2 in the rolling zone 344 is a function of the speeds of the belt conveyors 90 and 334.

The drum 306 is spaced apart from the belt conveyor 334 in such a way that the belt conveyor 90 begins to move away from and its outer side 91 advances tangentially of the peripheral surface 308 of the drum 306 at the inlet 320 of the rolling zone 344. The belt conveyors 344, 90 and/or the belt conveyor 344 and the peripheral surface of the drum 306 cooperate in the path portion 350 immediately ahead of the inlet 320 to gradually press the leading marginal portions of the bands 18 against the portions 16 of the respective articles 2. The width of the rolling zone 344 is less (e.g., slightly less) than the diameter 48 (FIG. 2) of an undeformed cylindrical article 2.

The endless belt conveyor 90 can include one, two or more endless flexible components which are guided in circumferentially complete grooves 313 of the cylindrical drum 306 or by discrete pulleys (not shown) alternating with coaxial cylindrical sections of the drum 306.

Figure 7:
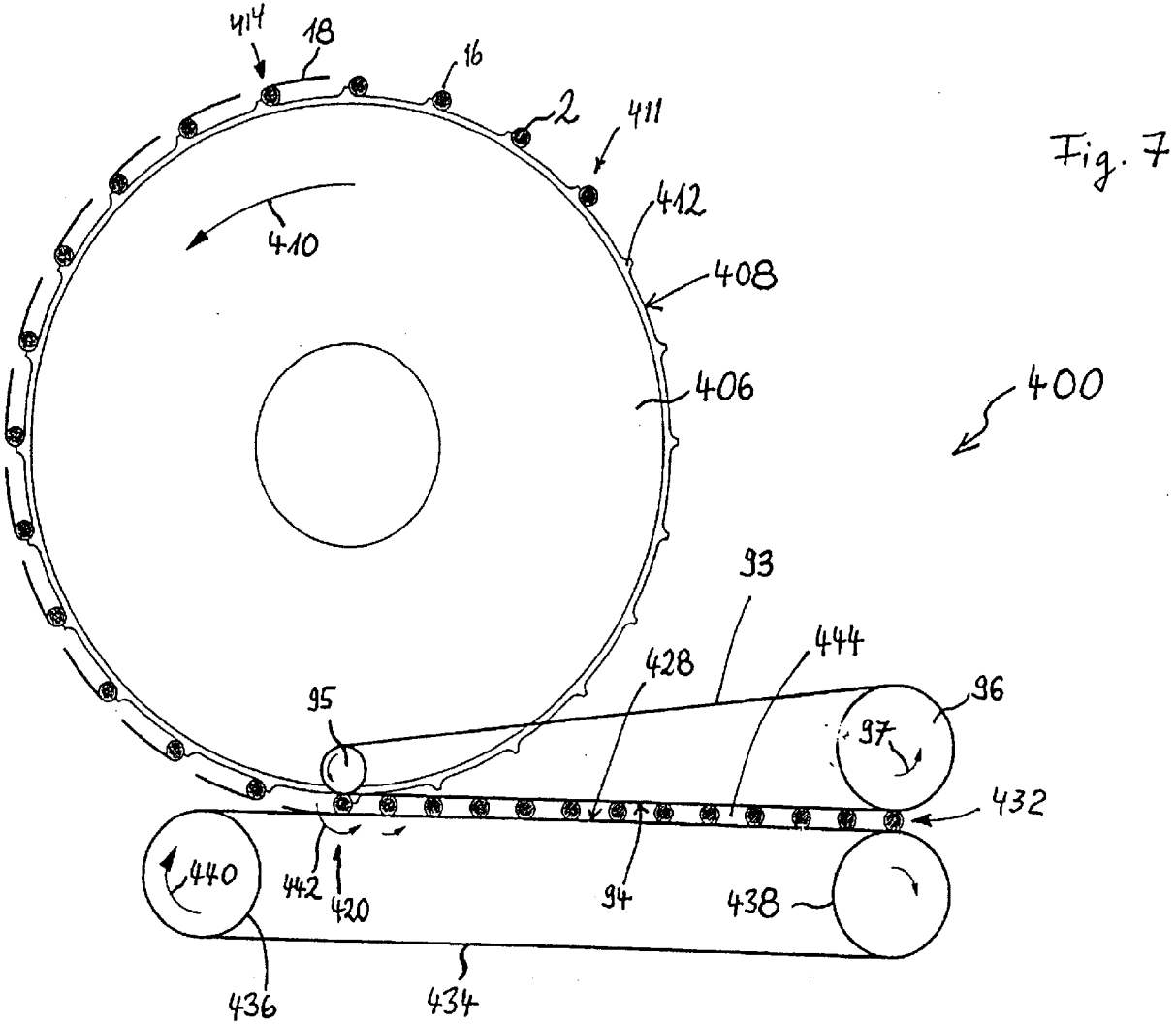
FIG. 7 is a schematic elevational view of an apparatus which constitutes a further modification of the apparatus shown in FIG. 1.

FIG. 7 shows certain parts of an apparatus 400 wherein the belt conveyor 90 of the apparatus 300 is replaced with an endless belt conveyor 93 which is not trained over the drum 406 but instead over a pulley 95 which is recessed into a cutout of the drum 406 or over two pulleys (corresponding to pulley 95) which flank the drum 406. All such parts of the apparatus 400 which are identical with or analogous to those of apparatus 1 of FIGS. 1 and 2 are denoted by similar reference characters plus 400 and will be described or referred to only to the extent necessary to ensure a full understanding of the construction and mode of operation of such fifth embodiment of our invention.

The belt conveyor 93 replaces the stationary rolling member 26 and the underside or surface 94 of its lower reach flanks the upper side of the rolling zone 444 the underside of which is adjacent the upper side or surface 428 of the upper reach of the belt conveyor 434. The surfaces 94, 428 are parallel to each other and the width of the rolling zone 444 is somewhat less than the diameter 48 of an undeformed article 2 on the drum 406. The speed of the belt conveyor 93 is less than (such as half) the speed of the belt conveyor 434, and the speed of the bands 18 borne by the articles 2 on the drum 406. The belt conveyor 93 is trained over pulleys 95, 96 one of which is driven (in a manner not specifically shown in FIG. 7) in the direction indicated by arrow 97. The pulleys 95, 96 in the apparatus 400 have different diameters. The speed of sidewise movement of articles 2 rolling in the zone or channel 444 is a function of the (different) speeds of the belt conveyors 93 and 434.

The surface 94 of the lower reach of the belt conveyor 93 is tangential to the peripheral surface 408 of the drum 406 starting at the inlet 420 of the rolling zone 444. The manner in which the peripheral surface 408 cooperates with the surface 428 in the path portion for articles 2 immediately upstream of the inlet 420 is identical with that described in connection with FIG. 2, i.e., these surfaces cooperate to press the bands 18 against the adjacent portions 16 of the respective articles 2 and to gradually deform (flatten) the articles to the extent which is necessary to ensure predictable rolling of articles on entry into the inlet 420 of the rolling zone 444.

The width of the outlet 432 of the rolling zone 444 increases rather abruptly in the nip of the pulleys 96, 438 of the apparatus 400, in contrast to the gradual widening of the outlets 232 and 332 in the apparatus 200 and 300 of FIGS. 4 and 5–6. It is also possible to provide the rolling zone of the improved apparatus with an outlet the width of which increases in a stepwise fashion. For example, the surface 24 of the stationary rolling member 26 at the outlet 32 of the rolling zone 44 of the apparatus 1 can recede stepwise upwardly and away from the upper reach of the belt conveyor 34, as seen in a direction to the right.

A feature which is common to all embodiments of the improved method and apparatus is that a marginal portion of each band 18 is pressed against the adjacent portion 16 of the respective article 2 with a progressively increasing force while the articles and the respective bands advance through that portion (such as 50) of their path toward the rolling zone (such as 44) which is located upstream of and is or can be immediately adjacent the inlet (such as 20) of the rolling zone. This not only strengthens the bond between each article and the respective band prior to start of the band convoluting operation (i.e., before the article is caused to begin to rotate about its axis in the rolling zone) but also ensures adequate compacting of each compressible article to ensure predictable rolling of articles as a result of contact with the surfaces (such as 24 and 28) bounding the rolling zone (such as 44).

It is to be borne in mind that a certain compacting or compression of rod-shaped articles which are to be provided with tubular envelopes consisting of convoluted uniting bands is unavoidable in all filter cigarette making or analogous machines. An important difference is that the improved method and apparatus ensure highly predictable and preferably gradually increasing adherence of the bands to the articles as well as highly predictable and gradual compacting of articles in the path portion preceding the inlet of the rolling zone.

In conventional apparatus, initial contact between an adhesive-coated uniting band and one of the surfaces bounding the rolling zone takes place while the uniting band and the one surface move relative to each other. In the apparatus of the present invention, the surface (e.g., 28) which engages the band 18 moves at the speed of the band which approaches the inlet of the rolling zone (e.g., of the zone 44); therefore, each article must be suddenly stressed only once, namely during entry of articles into the rolling zone when the articles are compelled to begin to turn about their respective axes. Such stressing of the articles in unavoidable but the rolling of articles about their axes is more predictable if the articles are subjected to a desirable compacting action and the bands 18 are pressed against the respective articles upstream of the locus of entry into the rolling zone or station.

Otherwise stated, conventional apparatus are designed in such a way that the rod-shaped articles begin to roll in immediate response to simultaneous contact with both surfaces which flank the rolling zone. In accordance with the present invention, the articles and/or their bands 18 are first contacted by one of the rolling surfaces (such as the surface 28 of the belt conveyor 34 shown in FIGS. 1 and 2), and are thereupon contacted by the other rolling surface (e.g., the surface 24 at the underside of the stationary rolling member 26). Such non-simultaneous establishment of contact between an article 2 and the associated band 18 on the one hand, and the surfaces 24, 28 flanking the rolling zone 44 on the other hand, contributes significantly to gentle treatment of the conveyed commodities and to superior quality of the ultimate products.

Another important advantage of the improved method and apparatus is that the portion (such as 50) of the path leading the articles toward and into the rolling zone (such as 44) is located immediately upstream of the inlet (20) of the rolling zone. This ensures that the selected compression of articles 2 in the path portion 50 can match the optimum compression of articles during combined sidewise and rolling movement in the zone 44.

Still another important advantage of the improved method and apparatus is that the compressing of the articles ahead of the rolling zone can take place, and preferably takes place, gradually. This not only results in a more satisfactory bonding of one marginal portion of each band 18 to the portion 16 of the respective article but also entails a more predictable compacting of each article to a dimension which is best suited for an optimum start of the rolling operation. The compacting can proceed gradually all the way from zero to a maximum value.

By compacting the articles, ahead of the rolling zone, to a dimension which matches or very closely approximates the width of the rolling zone, one can avoid any further compacting of articles immediately at the inlet of such zone.

The bands can consist of paper, such as the aforementioned tipping paper, of plastic foil (for example, for convolution around rod-shaped markers), or of any other suitable flexible material.

The feature that the width of the rolling zone increases, preferably gradually, reduces the likelihood of unpredictable (abrupt) deformation (expansion) of finished products in the region immediately downstream of the rolling zone. This can contribute to eye-pleasing appeal as well as to the quality of the ultimate products.

Commonly owned U.S. Pat. No. 4,445,519 (granted May 1, 1984 to Hinz et al.) discloses a method of and an apparatus for joining coaxial rod-shaped articles (such as plain cigarettes and filter mouthpieces) by means of adhesive-coated uniting bands. The uniting bands are conveyed by a drum along a predetermined path and are contacted by discrete rod-shaped articles each of which includes several rod-shaped parts or sections. Prior to entering the rolling station, the articles are pressed against the respective uniting bands to ensure that their positions relative to the bands remain unchanged until after the setting of adhesive to an optimum condition for bonding to the articles is completed. The application of pressure to the articles (so that the articles bear upon the respective uniting bands) is completed prior to entry of the articles into the rolling zone. This cannot ensure adequate or optimum compacting of rod-shaped articles at the time of their entry into the rolling zone. Thus, the articles must be compacted again when they reach the inlet of the rolling zone so that they must undergo repeated (discrete) compacting treatments, namely first by pressing them against the respective adhesive-coated uniting bands and thereupon at the time of entry into the rolling station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of draping bands around rod-shaped articles and, therefore, such adaptations should and are intended to be comprehended within the meaning and range of equivalence of the appended claims.

What is claimed is:

1. Apparatus for convoluting flexible bands around rod-shaped articles each having a predetermined diameter, comprising:

rolling means defining a rolling zone having an inlet, said rolling means including first and second surfaces which flank said rolling zone and confront each other across said rolling zone, at least one of said surfaces being arranged to move relative to the other thereof and said surfaces being spaced apart from each other a distance less than said diameter;

means for advancing a series of successive articles, with portions of bands adhering thereto, sideways in a predetermined direction along a predetermined path toward and into said inlet; and means for pressing the bands against the respective articles in a portion of said path immediately upstream of said inlet, as seen in said direction, wherein said portion of said path has a width that decreases toward said inlet to an extent such that the articles undergo deformation on their way into said rolling zone and wherein the width of said portion of said path decreases gradually all the way to said inlet.

2. The apparatus of claim 1, wherein the width of said portion of said path at least approximates said distance between said surfaces.

3. The apparatus of claim 1, wherein said portion of said path is bounded by third and fourth surfaces one of which is provided on said advancing means.

4. The apparatus of claim 3, wherein the other of said third and fourth surfaces is provided on said rolling means.

5. The apparatus of claim 1, whrein said advancing means comprises a drum rotatable about a predetermined axis and having a peripheral surface provided with article advancing elements at least substantially parallel to said axis.

6. The apparatus of claim 1, wherein said rolling means comprises at least one endless flexible conveyor arranged to move successive articles of said series sideways.

7. The apparatus of claim 1, wherein said rolling means comprises two endless flexible conveyors each of which is provided with one of said first and second surfaces.

8. The apparatus of claim 1, wherein said rolling means comprises at least one stationary rolling member and one of said first and second surfaces is provided on said rolling member.

9. The apparatus of claim 1, wherein said rolling zone has an outlet and said first and second surfaces include positions flanking said path at said outlet and diverging from each other.

10. The apparatus of claim 9, wherein said portions of said first and second surfaces diverge gradually.

11. The apparatus of claim 9, wherein said portions of said first and second surfaces diverge in a stepwise fashion.

12. The apparatus of claim 1, wherein said rolling zone has an outlet which is remote from said inlet as seen in said predetermined direction, said inlet being disposed at a first level and said outlet being disposed at a different second level.

13. The apparatus of claim 1, for convoluting adhesive-coated uniting bands around composite rod-shaped smokers' articles each consisting of a plurality of coaxial rod-shaped sections, wherein said surfaces are arranged to convolute the uniting bands around the respective composite articles so that the convoluted bands hold the sections of the respective articles against movement relative to each other.

14. A method of convoluting flexible bands around rod-shaped articles having predetermined diameters, comprising the steps of:

advancing a series of successive articles, with portions of bands appended thereto, sideways in a predetermined direction along a predetermined path toward an inlet of a rolling zone having a predetermined width so that an article entering the rolling zone is caused to roll and the respective band is convoluted therearound; and pressing the bands against the respective articles in a second zone immediately upstream of the inlet, as seen in said predetermined direction, wherein said pressing step includes a gradual reducing of the diameter of at least a portion of each successive article at least close to said predetermined width.

15. The method of claim 14 of convoluting bands around compressible rod-shaped articles, wherein said pressing step includes deforming the articles in said second zone.

16. The method of claim 14, wherein said advancing step includes moving the articles and the respective bands toward said second zone at a speed at least approximating a speed of a pair of surfaces bounding the rolling zone.

17. The method of claim 14, wherein the articles consist of a plurality of discrete coaxial sections and the bands are adhesive-coated uniting bands, said advancing step including convoluting the uniting bands around the respective articles to hold the sections of the articles against movement relative to each other.

* * * * *